US007078097B1

(12) United States Patent
Tam et al.

(10) Patent No.: US 7,078,097 B1
(45) Date of Patent: Jul. 18, 2006

(54) DRAWN GEL-SPUN POLYETHYLENE YARNS AND PROCESS FOR DRAWING

(75) Inventors: Thomas Yiu-Tai Tam, Richmond, VA (US); Chok B. Tan, Richmond, VA (US); Charles R. Arnett, Jr., Richmond, VA (US); Qiang Zhou, Chesterfield, VA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/205,951

(22) Filed: Aug. 17, 2005

Related U.S. Application Data

(62) Division of application No. 10/934,675, filed on Sep. 3, 2004, now Pat. No. 6,969,553.

(51) Int. Cl.
*D01F 6/00* (2006.01)

(52) U.S. Cl. ..... 428/364; 428/357; 428/394

(58) Field of Classification Search ..... 428/357, 428/364, 394
See application file for complete search history.

(56) References Cited

U.S. PATENT DOCUMENTS 4,413,110 A * 11/1983 Kavesh et al. ..... 526/348.1
4,551,296 A 11/1985 Kavesh et al. ..... 264/177 F
4,663,101 A * 5/1987 Kavesh et al. ..... 264/178 F
5,579,628 A * 12/1996 Dunbar et al. ..... 57/246
5,741,451 A 4/1998 Dunbar et al. ..... 264/103
5,884,617 A * 3/1999 Nelson ..... 124/90
5,958,583 A * 9/1999 Rorabaugh et al. ..... 428/365
6,448,359 B1 9/2002 Kavesh ..... 526/352
6,746,975 B1 * 6/2004 Kavesh ..... 442/135
6,979,660 B1 * 12/2005 Tam et al. ..... 442/108
2004/0040176 A1 3/2004 Mencke ..... 34/445

OTHER PUBLICATIONS

P. Smith et al., *Polymer Bulletin,* 1, 733 (1979).
R.G.Snyder et al., *J. Poly.Sci, Poly Phys Ed,* 16, 1593-1609 (1978).
V.A.Bershtein et al., "Differential Scanning Calorimetry of Polymers: Physics, Chemistry, Analysis, Technology", Ellis Horwod,, New York, p. 141-143, 1994.

* cited by examiner

*Primary Examiner*—N. Edwards
(74) *Attorney, Agent, or Firm*—Virginia Szigeti

(57) ABSTRACT

Gel-spun multi-filament polyethylene yarns possessing a high degree of molecular and crystalline order, and to the drawing methods by which they are produced. The drawn yarns are useful in impact absorption and ballistic resistance for body armor, helmets, breast plates, helicopter seats, spall shields, and other applications; composite sports equipment such as kayaks, canoes, bicycles and boats; and in fishing line, sails, ropes, sutures and fabrics.

1 Claim, 4 Drawing Sheets

DRAWN GEL-SPUN POLYETHYLENE YARNS AND PROCESS FOR DRAWING

This application is a divisional of application Ser. No. 10/934,675 filed Sep. 3, 2004 now U.S. Pat. No. 6,969,553.

BACKGROUND OF THE INVENTION

1. Field of the Invention

This invention relates to a process for drawing gel-spun polyethylene multi-filament yarns and to the drawn yarns produced thereby. The drawn yarns are useful in impact absorption and ballistic resistance for body armor, helmets, breast plates, helicopter seats, spall shields, and other applications; composite sports equipment such as kayaks, canoes, bicycles and boats; and in fishing line, sails, ropes, sutures and fabrics.

2. Description of the Related Art

To place the invention in perspective, it should be recalled that polyethylene had been an article of commerce for about forty years prior to the first gel-spinning process in 1979. Prior to that time, polyethylene was regarded as a low strength, low stiffness material. It had been recognized theoretically that a straight polyethylene molecule had the potential to be very strong because of the intrinsically high carbon—carbon bond strength. However, all then-known processes for spinning polyethylene fibers gave rise to "folded chain" molecular structures (lamellae) that inefficiently transmitted the load through the fiber and caused the fiber to be weak.

"Gel-spun" polyethylene fibers are prepared by spinning a solution of ultra-high molecular weight polyethylene (UHMWPE), cooling the solution filaments to a gel state, then removing the spinning solvent. One or more of the solution filaments, the gel filaments and the solvent-free filaments are drawn to a highly oriented state. The gel-spinning process discourages the formation of folded chain lamellae and favors formation of "extended chain" structures that more efficiently transmit tensile loads.

The first description of the preparation and drawing of UHMWPE filaments in the gel state was by P. Smith, P. J. Lemstra, B. Kalb and A. J. Pennings, *Poly. Bull.,* 1, 731 (1979). Single filaments were spun from 2 wt. % solution in decalin, cooled to a gel state and then stretched while evaporating the decalin in a hot air oven at 100 to 140° C.

More recent processes (see, e.g., U.S. Pat. Nos. 4,551,296, 4,663,101, and 6,448,659) describe drawing all three of the solution filaments, the gel filaments and the solvent-free filaments. A process for drawing high molecular weight polyethylene fibers is described in U.S. Pat. No. 5,741,451. The disclosures of these patents are hereby incorporated by reference to the extent not incompatible herewith.

Although gel-spinning processes tend to produce fibers that are free of lamellae with folded chain surfaces, nevertheless the molecules in gel-spun UHMWPE fibers are not free of gauche sequences as can be demonstrated by infrared and Raman spectrographic methods. The gauche sequences are kinks in the zig-zag polyethylene molecule that create dislocations in the orthorhombic crystal structure. The strength of an ideal extended chain polyethylene fiber with all trans —$(CH_2)_n$— sequences has been variously calculated to be much higher than has presently been achieved. While fiber strength and multi-filament yarn strength are dependent on a multiplicity of factors, a more perfect polyethylene fiber structure, consisting of molecules having longer runs of straight chain all trans sequences, is expected to exhibit superior performance in a number of applications such as ballistic protection materials.

A need exists for gel-spun multi-filament UHMWPE yarns having increased perfection of molecular structure. One measure of such perfection is longer runs of straight chain all trans —$(CH_2)_n$— sequences as can be determined by Raman spectroscopy. Another measure is a greater "Parameter of Intrachain Cooperativity of the Melting Process" as can be determined by differential scanning calorimetry (DSC). Yet another measure is the existence of two orthorhombic crystalline components as can be determined by x-ray diffraction. It is among the objectives of this invention to provide methods to produce such yarns by drawing, and the yarns so produced.

SUMMARY OF THE INVENTION

The invention comprises a process for drawing a gel-spun multi-filament yarn comprising the steps of:

a) forming a gel-spun polyethylene multi-filament feed yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents;

b) passing the feed yarn at a speed of $V_1$ meters/minute into a forced convection air oven having a yarn path length of L meters, wherein one or more zones are present along the yarn path having zone temperatures from 130° C. to 160° C.;

c) passing the feed yarn continuously through the oven and out of the oven at an exit speed of $V_2$ meters/minute wherein the following equations 1 to 4 are satisfied $$0.25 \leqq L/V_1 \leqq 20, \text{ min} \quad \text{Eq. 1}$$

$$3 \leqq V_2/V_1 \leqq 20 \quad \text{Eq. 2}$$

$$1.7 \leqq (V_2 - V_1)/L \leqq 60, \text{ min}^{-1} \quad \text{Eq. 3}$$

$$0.20 \leqq 2L/(V_1 + V_2) \leqq 10, \text{ min} \quad \text{Eq. 4}$$

The invention is also a novel polyethylene multi-filament yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents, the multi-filament yarn having a tenacity of at least 17 g/d as measured by ASTM D2256-02, wherein filaments of the yarn have a peak value of the ordered-sequence length distribution function F(L) at a straight chain segment length L of at least 35 nanometers as determined at 23° C. from the low frequency Raman band associated with the longitudinal acoustic mode (LAM-1).

In another embodiment, the invention is a novel polyethylene multi-filament yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents, the multi-filament yarn having a tenacity of at least 17 g/d as measured by ASTM D2256-02, wherein filaments of the yarn have a value of the "Parameter of Intrachain Cooperativity of the Melting Process", ν, of at least about 535.

In yet another embodiment, the invention is a novel polyethylene multi-filament yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents, the multi-filament, yarn having a tenacity of at least 17 g/d as measured by ASTM D2256-02, wherein the intensity of the (002) x-ray reflection of one the filament of the yarn, measured at room temperature and under no load, shows two distinct peaks.

BRIEF DESCRIPTION OF THE DRAWINGS

FIG. 2(*b*) is a plot of the ordered sequence length distribution function F(L) determined from the LAM-1 spectrum of a commercially available gel-spun multi-filament UHMWPE yarn (SPECTRA® 1000 yarn).

FIG. 2(*c*) is a plot of the ordered sequence length distribution function F(L) determined from the LAM-1 spectrum of filaments of the invention.

DETAILED DESCRIPTION OF THE INVENTION

Figure 1:
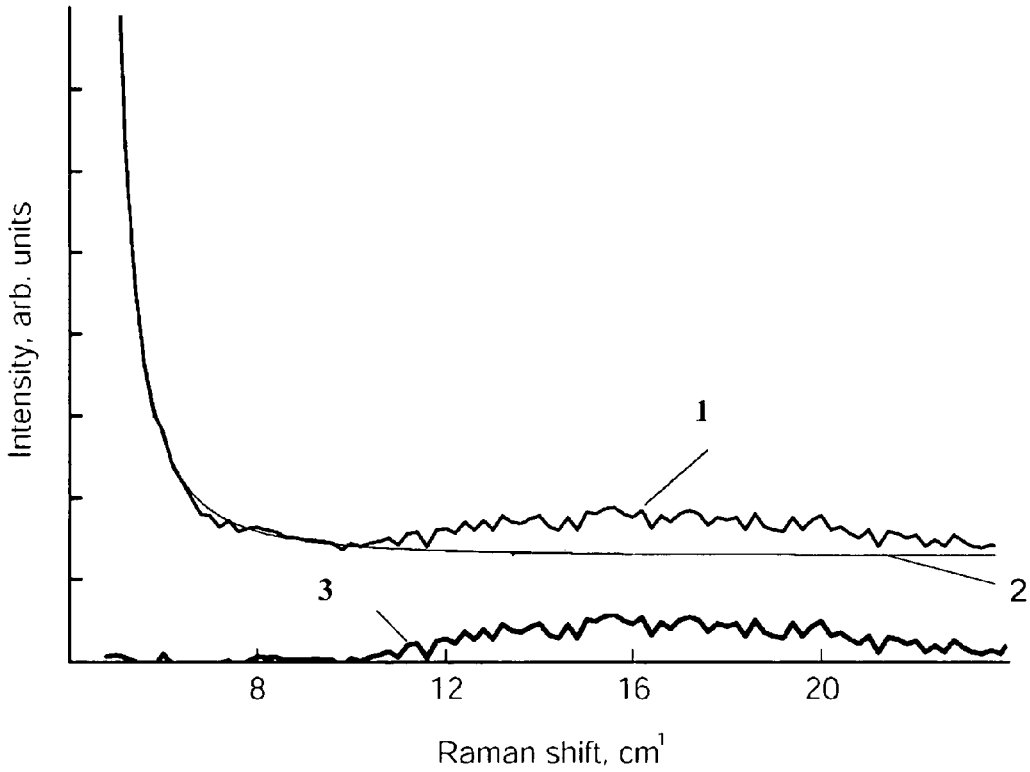
FIG. 1 is the low frequency Raman spectrum and extracted LAM-1 spectrum of filaments of a commercially available gel-spun multi-filament UHMWPE yarn (SPECTRA® 900 yarn).

In one embodiment, the invention comprises a process for drawing a gel-spun multi-filament yarn comprising the steps of:

a) forming a gel-spun polyethylene multi-filament feed yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents;

b) passing the feed yarn at a speed of $V_1$ meters/minute into a forced convection air oven having a yarn path length of L meters, wherein one or more zones are present along the yarn path having zone temperatures from about 130° C. to 160° C.;

c) passing the feed yarn continuously through the oven and out of the oven at an exit speed of $V_2$ meters/minute wherein the following equations 1 to 4 are satisfied $$0.25 \leqq L/V_1 \leqq 20, \text{ min} \quad \text{Eq. 1}$$

$$3 \leqq V_2/V_1 \leqq 20 \quad \text{Eq. 2}$$

$$1.7 \leqq (V_2 - V_1)/L \leqq 60, \text{ min} \quad \text{Eq. 3}$$

$$0.20 \leqq 2L/(V_1 + V_2) \leqq 10, \text{ min} \quad \text{Eq. 4}$$

For purposes of the present invention, a fiber is an elongate body the length dimension of which is much greater than the transverse dimensions of width and thickness. Accordingly, "fiber" as used herein includes one, or a plurality of filaments, ribbons, strips, and the like having regular or irregular cross-sections in continuous or discontinuous lengths. A yarn is an assemblage of continuous or discontinuous fibers.

Preferably, the multi-filament feed yarn to be drawn comprises a polyethylene having an intrinsic viscosity in decalin of from about 8 to 30 dl/g, more preferably from about 10 to 25 dl/g, and most preferably from about 12 to 20 dl/g. Preferably the multi-filament yarn to be drawn comprises a polyethylene having fewer than about one methyl group per thousand carbon atoms more preferably fewer than 0.5 methyl groups per thousand carbon atoms, and less than about 1 wt. % of other constituents.

The gel-spun polyethylene multi-filament yarn to be drawn in the process of the invention may have been previously drawn, or it may be in an essentially undrawn state. The process for forming the gel-spun polyethylene feed yarn can be one of the processes described by U.S. Pat. Nos. 4,551,296, 4,663,101, 5,741,451, and 6,448,659.

The tenacity of the feed yarn may range from about 2 to 76, preferably from about 5 to 66, more preferably from about 7 to 51, grams per denier (g/d) as measured by ASTM D2256-97 at a gauge length of 10 inches (25.4 cm) and at a strain rate of 100%/min.

It is known that gel-spun polyethylene yarns may be drawn in an oven, in a hot tube, between heated rolls, or on a heated surface. WO 02/34980 A1 describes a particular drawing oven. We have found that drawing of gel-spun UHMWPE multi-filament yarns is most effective and productive if accomplished in a forced convection air oven under narrowly defined conditions. It is necessary that one or more temperature-controlled zones exist in the oven along the yarn path, each zone having a temperature from about 130° C. to 160° C. Preferably the temperature within a zone is controlled to vary less than ±2° C. (a total less than 4° C.), more preferably less than ±1° C. (a total less than 2° C.).

The yarn will generally enter the drawing oven at a temperature lower than the oven temperature. On the other hand, drawing of a yarn is a dissipative process generating heat. Therefore to quickly heat the yarn to the drawing temperature, and to maintain the yarn at a controlled temperature, it is necessary to have effective heat transmission between the yarn and the oven air. Preferably, the air circulation within the oven is in a turbulent state. The time-averaged air velocity in the vicinity of the yarn is preferably from about 1 to 200 meters/min, more preferably from about 2 to 100 meters/min, most preferably from about 5 to 100 meters/min.

The yarn path within the oven may be in a straight line from inlet to outlet. Alternatively, the yarn path may follow a reciprocating ("zig-zag") path, up and down and/or back and forth across the oven, around idler rolls or internal driven rolls. It is preferred that the yarn path within the oven is a straight line from inlet to outlet.

The yarn tension profile within the oven is adjusted by controlling the drag on idler rolls, by adjusting the speed of internal driven rolls, or by adjusting the oven temperature profile. Yarn tension may be increased by increasing the drag on idler rolls, increasing the difference between the speeds of consecutive driven rolls or decreasing oven temperature. The yarn tension within the oven may follow an alternating rising and falling profile or it may increase steadily from inlet to outlet, or it may be constant. Preferably, the yarn tension everywhere within the oven is constant neglecting the effect of air drag, or it increases through the oven. Most preferably, the yarn tension everywhere within the oven is constant neglecting the effect of air drag.

The drawing process of the invention provides for drawing multiple yarn ends simultaneously. Typically, multiple packages of gel-spun polyethylene yarns to be drawn are placed on a creel. Multiple yarns ends are fed in parallel from the creel through a first set of rolls that set the feed speed into the drawing oven, and thence through the oven and out to a final set of rolls that set the yarn exit speed and also cool the yarn to room temperature under tension. The tension in the yarn during cooling is maintained sufficient to hold the yarn at its drawn length neglecting thermal contraction.

The productivity of the drawing process may be measured by the weight of drawn yarn that can be produced per unit of time per yarn end. Preferably, the productivity of the process is more than about 2 grams/minute per yarn end, more preferably more than about 4 grams/minute per yarn end.

In another embodiment, the invention is a novel polyethylene multi-filament yarn comprising a polyethylene having an intrinsic viscosity in decalin at 135° C. of from 5 dl/g to 35 dl/g, fewer than two methyl groups per thousand carbon atoms, and less than 2 wt. % of other constituents, the multi-filament yarn having a tenacity of at least 17 g/d as measured by ASTM D2256-02, wherein filaments of the yarn have a peak value of the ordered-sequence length distribution function F(L) at a straight chain segment length L of at least 40 nanometers as determined at 23° C. from the low frequency Raman band associated with the longitudinal acoustic mode (LAM-1).

In yet another embodiment, the invention is a novel polyethylene multi-filament yarn comprising a polyethylene having an intrinsic viscosity in decalin at 135° C. of from 5 dl/g to 35 dl/g, fewer than two methyl groups per thousand carbon atoms, and less than 2 wt. % of other constituents, the multi-filament yarn having a tenacity of at least 17 g/d as measured by ASTM D2256-02, wherein filaments of the yarn have a value of the "Parameter of Intrachain Cooperativity of the Melting Process", ν, of at least 535.

In a further embodiment, the invention is a novel polyethylene multi-filament yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents, the multi-filament yarn having a tenacity of at least 17 g/d as measured by ASTM D2256-02, wherein the intensity of the (002) x-ray reflection of one filament of the yarn, measured at room temperature and under no load, shows two distinct peaks.

Preferably, a polyethylene yarn of the invention has an Intrinsic viscosity in decalin at 135° C. of from about 7 dl/g to 30 dl/g, fewer than about one methyl group per thousand carbon atoms, less than about 1 wt. % of other constituents, and a tenacity of at least 22 g/d.

Measurement Methods

1. Raman Spectroscopy

Raman spectroscopy measures the change in the wavelength of light that is scattered by molecules. When a beam of monochromatic light traverses a semi-transparent material, a small fraction of the light is scattered in directions other than the direction of the incident beam. Most of this scattered light is of unchanged frequency. However, a small fraction is shifted in frequency from that of the incident light. The energies corresponding to the Raman frequency shifts are found to be the energies of rotational and vibrational quantum transitions of the scattering molecules. In semi-crystalline polymers containing all-trans sequences, the longitudinal acoustic vibrations propagate along these all-trans segments as they would along elastic rods. The chain vibrations of this kind are called longitudinal acoustic modes (LAM), and these modes produce specific bands in the low frequency Raman spectra. Gauche sequences produce kinks in the polyethylene chains that delimit the propagation of acoustic vibrations. It will be understood that in a real material a statistical distribution exists of the lengths of all-trans segments. A more perfectly ordered material will have a distribution of all-trans segments different from a less ordered material. An article titled, "Determination of the Distribution of Straight-Chain Segment Lengths in Crystalline Polyethylene from the Raman LAM-1 Band", by R. G. Snyder et al, *J. Poly. Sci. Poly. Phys. Ed.,* 16, 1593–1609 (1978) describes the theoretical basis for determination of the ordered-sequence length distribution function, F(L) from the Raman LAM-1 spectrum.

F(L) is determined as follows: Five or six filaments are withdrawn from the multi-filament yarn and placed in parallel alignment abutting one another on a frame such that light from a laser can be directed along and through this row of fibers perpendicular to their length dimension. The laser light should be substantially attenuated on passing sequentially through the fibers. The vector of light polarization is collinear with the fiber axis, (XX light polarization).

Spectra are measured at 23° C. on a spectrometer capable of detecting the Raman spectra within a few wave numbers (less than about 4 $cm^{-1}$) of the exciting light. An example of such a spectrometer is the SPEX Industries, Inc, Metuchen, N.J., Model RAMALOG® 5, monochromator spectrometer using a He—Ne laser. The Raman spectra are recorded in 90° geometry, i.e. the scattered light is measured and recorded at an angle of 90 degrees to the direction of incident light. To exclude the contribution of the Rayleigh scattering, a background of the LAM spectrum in the vicinity of the central line must be subtracted from the experimental spectrum. The background scattering is fitted to a Lorentzian function of the form given by Eq. 5 using the initial part of the Raman scattering data, and the data in the region 30–60 $cm^{-1}$ where there is practically no Raman scattering from the samples, but only background scattering.

$$f(x)) = \frac{H}{4\cdot\left(\frac{x-x_0}{w}\right)^2+1} \qquad \text{Eq. 5}$$

where: $x_0$ is the peak position

H is the peak height w is the full width at half maximum

Where the Raman scattering is intense near the central line in the region from about 4 $cm^{-1}$ to about 6 $cm^{-1}$, it is necessary to record the Raman intensity in this frequency range on a logarithmic scale and match the intensity recorded at a frequency of 6 $cm^{-1}$ to that measured on a linear scale. The Lorentzian function is subtracted from each separate recording and the extracted LAM spectrum is spliced together from each portion.

FIG. 1(*a*) shows the measured Raman spectra for a fibermaterial to be described below and the method of subtraction of the background and the extraction of the LAM spectrum.

The LAM-1 frequency, is inversely related to the straight chain length, L as expressed by Eq. 6.

$$L = \frac{1}{2c\omega_L}\left(\frac{Eg_c}{\rho}\right)^{1/2} \quad \text{Eq. 6}$$

where: c is the velocity of light, $3\times10^{10}$ cm/sec $\omega_L$ is the LAM-1 frequency, $cm^{-1}$ E is the elastic modulus of a polyethylene molecule, $g(f)/cm^2$ ρ is the density of a polyethylene crystal, $g(m)/cm^3$ $g_c$ is the gravitational constant 980 (g(m)-cm)/((g(f)-$sec^2$)

For the purposes of this invention, the elastic modulus E, is taken as 340 GPa as reported by Mizushima et al., *J. Amer. Chem. Soc.,* 71, 1320 (1949). The quantity $(g_cE/\rho)^{1/2}$ is the sonic velocity in an all trans polyethylene crystal. Based on an elastic modulus of 340 GPa, and a crystal density of 1,000 $g/cm^3$, the sonic velocity is $1.844\times10^6$ cm/sec. Making that substitution in Eq. 6, the relationship between the straight chain length and the LAM-1 frequency as used herein is express by Eq. 7.

$$L = \frac{307.3}{\omega_L}, \text{ nanometers} \quad \text{Eq. 7}$$

The "ordered-sequence length distribution function", F(L), is calculated from the measured Raman LAM-1 spectrum by means of Eq. 8.

$$F(L) = \left[1 - \exp\left(-\frac{hc\omega_L}{kT}\right)\omega_L^2 I_\omega\right], \text{ arbitrary units} \quad \text{Eq. 8}$$

where: h is Plank's constant, $6.6238\times10^{-27}$ erg-cm k is Boltzmann's constant, $1.380\times10^{16}$ erg/° K $I_\omega$ is the intensity of the Raman spectrum at frequency $\omega_L$, arbitrary units T is the absolute temperature, ° K and the other terms are as previously defined.

Figure 2:
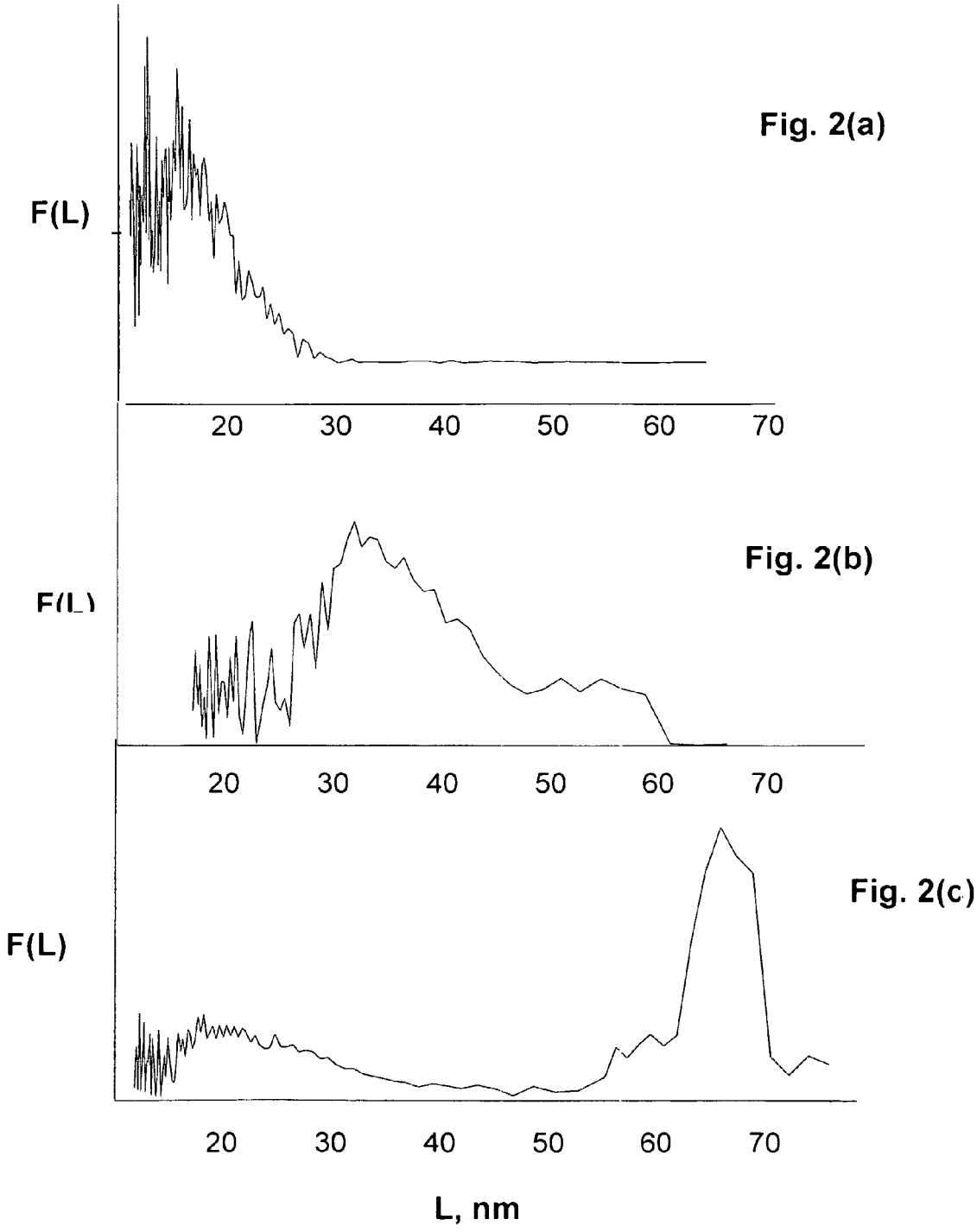
FIG. 2(*a*) is a plot of the ordered sequence length distribution function F(L) determined from the LAM-1 spectrum of FIG. 1.

Plots of the ordered-sequence length distribution function, F(L), derived from the Raman LAM-1 spectra for three polyethylene samples to be described below are shown in FIGS. 2(*a*), 2(*b*) and 2(*c*).

Preferably, a polyethylene yarn of the invention is comprised of filaments for which the peak value of F(L) is at a straight chain segment length L of at least 45 nanometers as determined at 23° C. from the low frequency Raman band associated with the longitudinal acoustic mode (LAM-1). The peak value of F(L) preferably is at a straight chain segment length L of at least 50 nanometers, more preferably at least 55 nanometers, and most preferably 50–150 nanometers.

2. Differential Scanning Calorimetry (DSC)

It is well known that DSC measurements of UHMWPE are subject to systematic errors cause by thermal lags and inefficient heat transfer. To overcome the potential effect of such problems for the purposes of the invention the DSC measurements are carried out in the following manner. A filament segment of about 0.03 mg mass is cut into pieces of about 5 mm length. The cut pieces are arranged in parallel array and wrapped in a thin Wood's metal foil and placed in an open sample pan. DSC measurements of such samples are made for at least three different heating rates at or below 2° K/min and the resulting measurements of the peak temperature of the first polyethylene melting endotherm are extrapolated to a heating rate of 0° K/min.

A "Parameter of Intrachain Cooperativity of the Melting Process", represented by the Greek letter ν, has been defined by V. A. Bershtein and V. M. Egorov, in "Differential Scanning Calorimetry of Polymers: Physics, Chemistry, Analysis, Technology", P. 141–143, Tavistoc/Ellis Horwod, 1993. This parameter is a measure of the number of repeating units, here taken as (—$CH_2$—$CH_2$—), that cooperatively participate in the melting process and is a measure of crystallite size. Higher values of ν indicate longer crystalline sequences and therefore a higher degree of order. The "Parameter of Intrachain Cooperativity of the Melting Process" is defined herein by Eq. 9.

$$\nu = 2R\frac{T_{m1}^2}{\Delta T_{m1}\cdot\Delta H^0}, \text{ dimensionless} \quad \text{Eq. 9}$$

where: R is the gas constant, 8.31 J/° K-mol $T_{m1}$ is the peak temperature of the first polyethylene melting endotherm at a heating rate extrapolated to 0° K/min, ° K $\Delta T_{m1}$ is the width of the first polyethylene melting endotherm, ° K ΔH° is the melting enthalpy of —$CH_2$—$CH_2$— taken as 8200 J/mol The multi-filament yarns of the invention are comprised of filaments having a "Parameter of Intrachain Cooperativity of the Melting Process", ν, of at least 535, preferably at least 545, more preferably at least 555, and most preferably from 545 to 1100.

3. X-Ray Diffraction

A synchrotron is used as a source of high intensity x-radiation. The synchrotron x-radiation is monochromatized and collimated. A single filament is withdrawn from the yarn to be examined and is placed in the monochromatized and collimated x-ray beam. The x-radiation scattered by the filament is detected by electronic or photographic means with the filament at room temperature (~23° C.) and under no external load. The position and intensity of the (002) reflection of the orthorhombic polyethylene crystals are recorded. If upon scanning across the (002) reflection, the slope of scattered intensity versus scattering angle changes from positive to negative twice, i.e., if two peaks are seen in the (002) reflection, then two orthorhombic crystalline phases exist within the fiber.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES

Comparative Example 1

An UHMWPE gel-spun yarn designated SPECTRA® 900 was manufactured by Honeywell International Inc. in accord with U.S. Pat. No. 4,551,296. The 650 denier yarn consisting of 60 filaments had an intrinsic viscosity in decalin at 135° C. of about 15 dl/g. The yarn tenacity was about 30 g/d as measured by ASTM D2256-02, and the yarn contained less than about 1 wt. % of other constituents. The yarn had been stretched in the solution state, in the gel state and after removal of the spinning solvent. The stretching conditions did not fall within the scope of equations 1 to 4 of the present invention.

Filaments of this yarn were characterized by Raman spectroscopy using a Model RAMALOG® 5, monochromator spectrometer made by SPEX Industries, Inc., Metuchen, N.J., using a He—Ne laser and the methodology described herein above. The measured Raman spectrum, 1. and the extracted LAM-1 spectrum for this material, 3, after subtraction of the Lorenzian, 2, fitted to the Rayleigh background scattering are shown in FIG. 1(*a*). The ordered-sequence length distribution function, F(L), for this material determined from the LAM-1 spectrum and equations 7 and 8 is shown in FIG. 2(*a*). The peak value of the ordered-sequence length distribution function, F(L), was at a straight chain segment length L of approximately 12 nanometers (Table I).

Filaments of this yarn were also characterized by DSC using the methodology described hereinabove. The peak temperature of the first polyethylene melting endotherm at a heating rate extrapolated to 0° K/min. was 415.4° K. The width of the first polyethylene melting endotherm was 0.9° K. The "Parameter of Intrachain Cooperativity of the Melting Process", V, determined from Eq. 9 was 389 (Table I).

A single filament taken from this yarn was examined by x-ray diffraction using the methodology described hereinabove. Only one peak was seen in the (002) reflection (Table 1).

Comparative Example 2

An UHMWPE gel-spun yarn designated SPECTRA® 1000 was manufactured by Honeywell International Inc. in accord with U.S. Pat. Nos. 4,551,296 and 5,741,451. The 1300 denier yarn consisting of 240 filaments had an intrinsic viscosity in decalin at 135° C. of about 14 dl/g. The yarn tenacity was about 35 g/d as measured by ASTM D2256-02, and the yarn contained less than 1 wt. % of other constituents. The yarn had been stretched in the solution state, in the gel state and after removal of the spinning solvent. The stretching conditions did not fall within the scope of equations 1 to 4 of the present invention.

Filaments of this yarn were characterized by Raman spectroscopy using a Model RAMALOG® 5, monochromator spectrometer made by SPEX Industries, Inc. Metuchen, N.J. using a He—Ne laser and the methodology described hereinabove. The ordered-sequence length distribution function, F(L), for this material determined from the LAM-1 spectrum and equations 7 and 8 is shown in FIG. 2(*b*). The peak value of the ordered-sequence length distribution function, F(L), was at a straight chain segment length L of approximately 33 nanometers (Table I).

Filaments of this yarn were also characterized by DSC using the methodology described hereinabove. The peak temperature of the first polyethylene melting endotherm at a heating rate extrapolated to 0° K/min, was 415.2° K. The width of the first polyethylene melting endotherm was 1.3° K. The "Parameter of Intrachain Cooperativity of the Melting Process", ν, determined from Eq. 9 was 466 (Table I).

A single filament taken from this yarn was examined by x-ray diffraction using the methodology described hereinabove. Only one peak was seen in the (002) reflection (Table 1).

Comparative Examples 3–7

UHMWPE gel spun yarns from different lots manufactured by Honeywell International Inc. and designated either SPECTRA® 900 or SPECTRA® 1000 were characterized by Raman spectroscopy, DSC, and x-ray diffraction using the methodologies described hereinabove. The description of the yarns and the values of F(L) and ν are listed in Table I as well as the number of peaks seen in the (002) x-ray reflection.

EXAMPLE OF THE INVENTION

An UHMWPE gel spun yarn was produced by Honeywell International Inc. in accord with U.S. Pat. No. 4,551,296. The 2060 denier yarn consisting of 120 filaments had an intrinsic viscosity in decalin at 135° C. of about 12 dl/g. The yarn tenacity was about 20 g/d as measured by ASTM D2256-02, and the yarn contained less than about 1 wt. % of other constituents. The yarn had been stretched between 3.5 and 8 to 1 in the solution state, between 2.4 to 4 to 1 in the gel state and between 1.05 and 1.3 to 1 after removal of the spinning solvent.

The yarn was fed from a creel, through a set of restraining rolls at a speed ($V_1$) of about 25 meters/min into a forced convection air oven in which the internal temperature was 155±1° C. The air circulation within the oven was in a turbulent state with a time-averaged velocity in the vicinity of the yarn of about 34 meters/min.

The feed yarn passed through the oven in a straight line from inlet to outlet over a path length (L) of 14.63 meters and thence to a second set of rolls operating at a speed ($V_2$) of 98.8 meters/min. The yarn was cooled down on the second set of rolls at constant length neglecting thermal contraction. The yarn was thereby drawn in the oven at constant tension neglecting the effect of air drag. The above drawing conditions in relation to Equations 1–4 were as follows:

$$0.25 \leqq [L/V_1 = 0.59] \leqq 20, \text{ min} \quad \text{Eq. 1}$$

$$3 \leqq [V_2/V_1 = 3.95] \leqq 20 \quad \text{Eq. 2}$$

$$1.7 \leqq [(V_2 - V_1)/L = 5.04] \leqq 60, \text{ min}^{-1} \quad \text{Eq. 3}$$

$$0.20 \leqq [2L/(V_1 + V_2) = 0.24] \leqq 10, \text{ min} \quad \text{Eq. 4}$$

Hence, each of Equations 1–4 was satisfied.

The denier per filament (dpf) was reduced from 17.2 dpf for the feed yarn to 4.34 dpf for the drawn yarn. Tenacity was increased from 20 g/d for the feed yarn to about 40 g/d for the drawn yarn. The mass throughput of drawn yarn was 5.72 grams/min per yarn end.

Filaments of this yarn produced by the process of the invention were characterized by Raman spectroscopy using a Model RAMALOG® 5, monochromator spectrometer made by SPEX Industries, Inc., Metuchen, N.J., using a He—Ne laser and the methodology described hereinabove. The ordered-sequence length distribution function, F(L), for this material determined from the LAM-1 spectrum and equations 7 and 8 is shown in FIG. 2(*c*). The peak value of the ordered-sequence length distribution function, F(L), was at a straight chain segment length L of approximately 67 nanometers (Table I).

Figure 3:
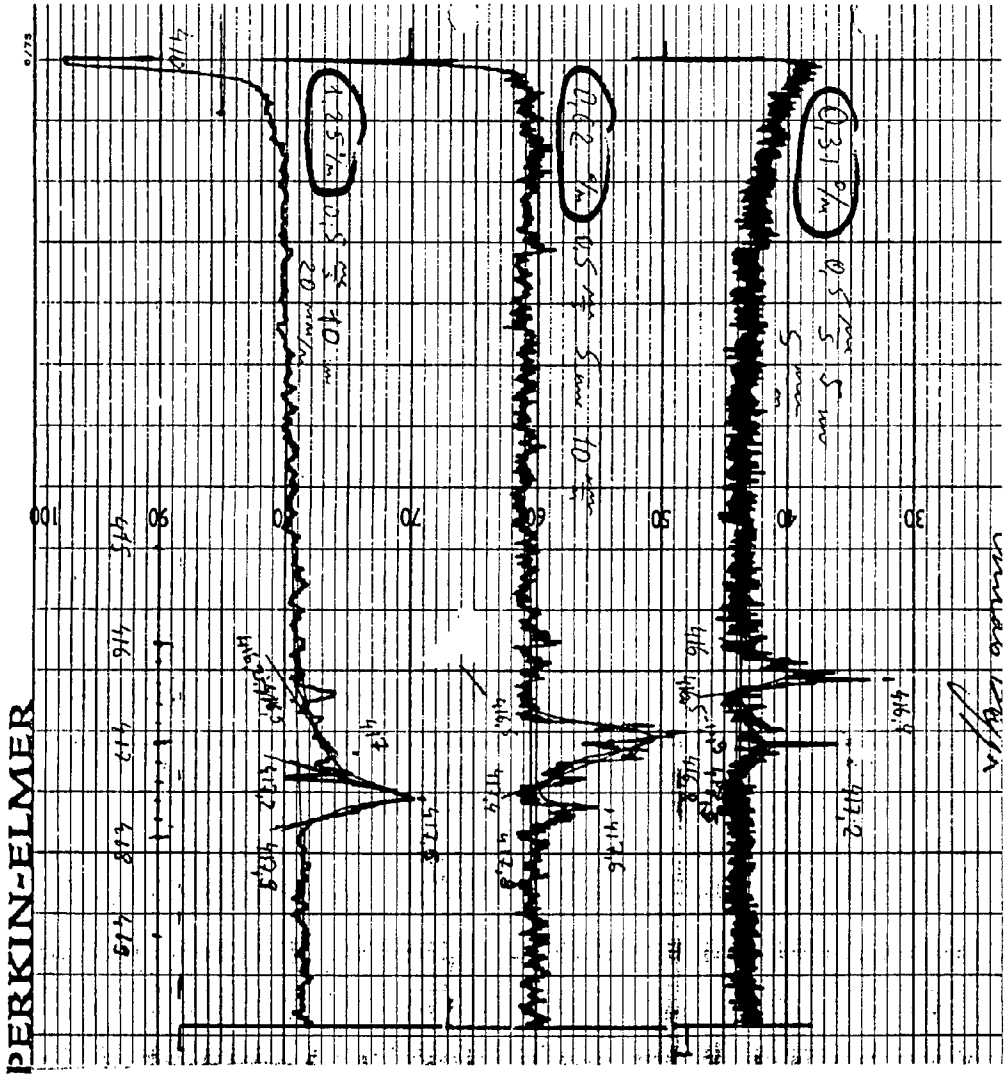
FIG. 3 shows differential scanning calorimetry (DSC) scans at heating rates of 0.31, 0.62 and 1.25° K/min of a 0.03 mg filament segment taken from a multi-filament yarn of the invention chopped into pieces of 5 mm length and wrapped in parallel array in a Wood's metal foil and placed in an open sample pan.

Filaments of this yarn were also characterized by DSC using the methodology described hereinabove. DSC scans at heating rates of 0.31° K/min, 0.62° K/min, and 1.25° K/min are shown in FIG. 3. The peak temperature of the first polyethylene melting endotherm at a heating rate extrapolated to 0° K/min, was 416.1° K. The width of the first polyethylene melting endotherm was 0.6° K. The "Parameter of Intrachain Cooperativity of the Melting Process", ν, determined from Eq. 9 was 585 (Table I).

Figure 4:
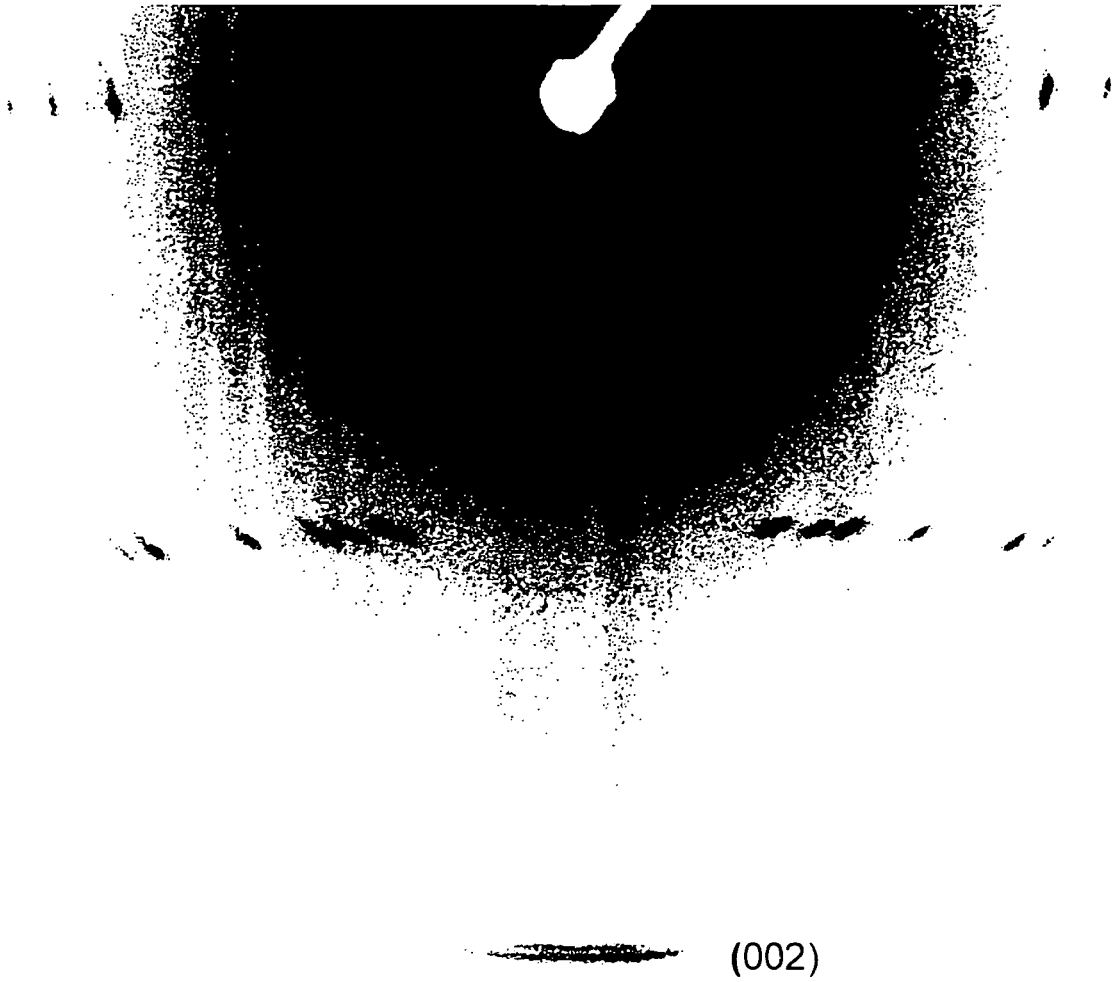
FIG. 4 shows an x-ray pinhole photograph of a single filament taken from multi-filament yarn of the invention.

A single filament taken from this yarn was examined by x-ray diffraction using the methodology described hereinabove. An x-ray pinhole photograph of the filament is shown in FIG. 4. Two peaks were seen in the (002) reflection.

TABLE I

| Ex. or Comp. Ex. No. | Identification | Denier/ Fils | L, nm at peak of F (L) | ν, dimension-less | No. of (002) X-Ray Peaks |
|---|---|---|---|---|---|
| Comp. Ex. 1 | SPECTRA ® 900 yarn | 650/60 | 12 | 389 | 1 |
| Comp. Ex. 2 | SPECTRA ® 1000 yarn | 1300/240 | 33 | 466 | 1 |
| Comp. Ex. 3 | SPECTRA ® 900 yarn | 650/60 | 28 | 437 | 1 |
| Comp. Ex. 4 | SPECTRA ® 900 yarn | 1200/120 | 19 | 387 | 1 |
| Comp. Ex. 5 | SPECTRA ® 900 yarn | 1200/120 | 20 | 409 | 1 |
| Comp. Ex. 6 | SPECTRA ® 900 yarn | 1200/120 | 24 | 435 | 1 |
| Comp. Ex. 7 | SPECTRA ® 1000 yarn | 1300/240 | 17 | 467 | 1 |
| Example | Inventive Fiber | 521/120 | 67 | 585 | 2 |

It is seen that filaments of the yarn of the invention had a peak value of the ordered-sequence length distribution function. F(L), at a straight chain segment length, L, greater than the prior art yarns. It is also seen that filaments of the yarn of the invention had a "Parameter of Intrachain Cooperativity of the Melting Process", ν, greater than the prior art yarns. Also, this appears to be the first observation of two (002) x-ray peaks in a polyethylene filament at room temperature under no load.

Having thus described the invention in rather full detail, it will be understood that such detail need not be strictly adhered to but that further changes and modifications may suggest themselves to one skilled in the art, all falling with the scope of the invention as defined by the subjoined claims.

What is claimed is:

1. A polyethylene multi-filament yarn comprising a polyethylene having an intrinsic viscosity in decalin at 135° C. of from about 5 dl/g to 35 dl/g, fewer than about two methyl groups per thousand carbon atoms, and less than about 2 wt. % of other constituents, said multi-filament yarn having a tenacity of at least 17 g/d as measured by ASTM D2256-02, wherein filaments of said yarn have a peak value of the ordered-sequence length distribution function, F(L), at a straight chain segment length L of at least 40 nanometers as determined at 23° C. from the low frequency Raman band associated with the longitudinal acoustic mode (LAM-1), and a parameter of intrachain cooperativity of the melting process, ν, of at least 535 as determined by differential scanning calorimetry (DSC) of the first polyethylene melting endotherm at a heating rate extrapolated to 0° K/min from at least 3 melting scans at heating rates less than 2° K/min, said DSC calorimetry being conducted of a filament segment of about 0.03 mg mass cut into pieces of about 5 mm length wrapped in parallel array in a Wood's metal foil and placed in an open sample pan.

* * * * *